United States Patent [19]

Wise

[11] 3,984,980

[45] Oct. 12, 1976

[54] INTEGRAL HEATER THERMAL ENERGY STORAGE DEVICE

[75] Inventor: Joseph Wise, Dayton, Ohio

[73] Assignee: The United States of America as represented by the Secretary of the Air Force, Washington, D.C.

[22] Filed: Aug. 5, 1975

[21] Appl. No.: 602,039

[52] U.S. Cl. ..... 60/517; 165/105; 219/278

[51] Int. Cl.[2] ..... F02G 1/04; H05B 3/14

[58] Field of Search ..... 60/517, 524, 659; 62/6; 219/378, 365, 530; 165/105

[56] References Cited

UNITED STATES PATENTS

| | | | |
|---|---|---|---|
| 3,069,527 | 12/1962 | Kovacik | 219/378 X |
| 3,889,096 | 6/1975 | Asselman et al. | 165/105 X |
| 3,933,000 | 1/1976 | Doody | 62/6 |

*Primary Examiner*—William E. Wayner
*Attorney, Agent, or Firm*—Joseph E. Rusz; Robert Kern Duncan

[57] ABSTRACT

In a Vuilleumier cryogenic refrigerating system for operation wherein the source of thermal energy for the hot cylinder during periods of interrupted electrical energy is supplied by heat of fusion of the thermal energy storage material, the container for the thermal energy storage material is made the electrical heating element for both the refrigerator and the thermal energy storage material.

3 Claims, 6 Drawing Figures

INTEGRAL HEATER THERMAL ENERGY STORAGE DEVICE

RIGHTS OF THE GOVERNMENT

The invention described herein may be manufactured and used by or for the Government of the United States for all governmental purposes without the payment of any royalty.

BACKGROUND OF THE INVENTION

The field of the invention is in combined thermal and thermal storage devices.

In many instances it is desirable to maintain a relative constant temperature during interruptions of a primary source of energy. To cite a specific example, infrared sensors when in use must be maintained at a relative low temperature (generally less than 100° K) in order to minimize background noise. Vuilleumier cryogenic refrigerators are commonly used to provide a relatively cold temperature (less than 100° K) with a relatively small cooling capacity (2 to 3 watts) to a relatively small area. Typical Vuilleumier refrigerators utilize electrical energy to operate the motors driving the pistons and to heat the heating element around the end of the hot cylinder. In earth orbiting satellites this electrical energy is supplied from photovoltaic (solar) cells as the primary source and storage batteries are used as a secondary source to supply the electrical energy when the satellite is in the earth's shadow region. The hot cylinder heater element takes a relatively large amount of electrical power and from a space and weight consideration it has been found advantageous to furnish the thermal energy to the hot cylinder when the satellite is in the penumbra and umbra regions by thermal energy storage (TES) material rather than from on-board batteries. This permits the use of a smaller battery system, but in the prior art systems it has added the complications of separately heating the TES material and then conducting the thermal energy from the TES material to the hot cylinder. Heat pipes have been used to conduct heat from a compact heating element to the hot cylinder. All of the prior art devices have been bulky, space consuming, heavy, and of somewhat marginal improvement over battery power.

Typical examples of the prior art may be found in U.S. Pat. Nos. 3,293,409 to C. D. Snelling, 3,356,828 to R. F. Furness, 3,381,113 to D. K. Jacques et al. and 3,624,356 to C. D. Havill.

SUMMARY OF THE INVENTION

A compact, light weight intergral heater and thermal energy storage device is provided in which the thermal energy source for direct utilization is the same device as the thermal energy source for the thermal energy storage material. The disclosed system is particularly suitable for supplying continuous thermal energy to the hot cylinder of a Vuilleumier cryogenic cooler in situations wherein the primary source of power undergoes interruptions.

BRIEF DESCRIPTION OF THE DRAWING

FIG. 6 is a schematic representation showing typical electrical connections to the integral heaters and thermal storage elements of the invention.

DESCRIPTION OF THE PREFERRED EMBODIMENT

Figure 1:
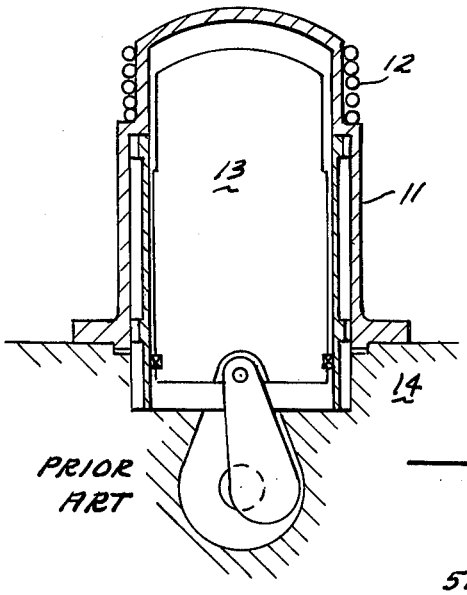
FIG. 1 is a schematic partial section view of a typical prior art hot cylinder arrangement of a Vuilleumier cryogenic cooler showing the conventional electrical heating element.
Figure 2:
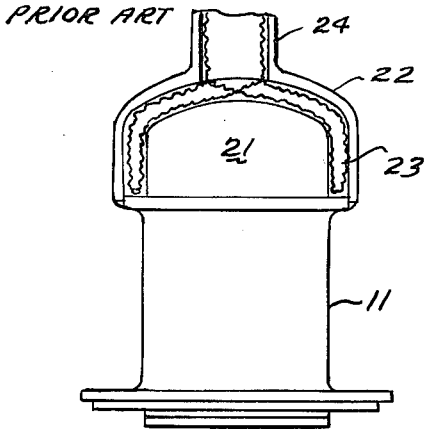
FIG. 2 is a schematic representation of a typical prior art heat pipe arrangement for supplying thermal energy to the hot cylinder of a Vuilleumier cooler.

A typical hot cylinder of a conventional Vuilleumier cryogenic cooler is shown in FIG. 1. The cylinder wall 11 mounted on the crankcase 14 contains the hot piston 13. Conventional electrical heating element 12 supplies the thermal energy required for operation. FIG. 2 shows a prior art device in which thermal energy is supplied to the head of hot cylinder 11 by a heat pipe 22. Hot head heat pipe 22 is supplied thermal energy from a feeder heat pipe 24. A conventional electrical heating element (not shown) applies thermal energy to the feeder heat pipe. The heat pipe 22 and feeder pipe 24 contain conventional screen wick structure 23 common to heat pipes. Typically the hot cylinder head 21 is maintained at temperatures of approximately 1275° F to 1400° F.

As previously indicated Vuilleumier cryogenic coolers are used on satellites to cool infrared sensors. It is desirable that the sensors remain in continuous operation. The primary source of electrical power on the satellite is furnished by solar cells which for example may be interrupted for approximately 1 hour every 12 hours. Most spacecraft are weight and volume limited. Thermal balance and power inefficiency can severely penalize the spacecraft. An improved power source for spacecraft is provided by this invention in the following ways. By integrating the heating and energy storage functions efficient thermal power is provided since the common thermal insulation serves for both functions; energy storage thermally is lighter weight than equivalent electrical energy storage; and containers for the TES material also serve as the electrical heaters providing a weight and space saving. Typically the weight saved by this invention is approximately 400 lb/kw hour stored.

Figure 4:
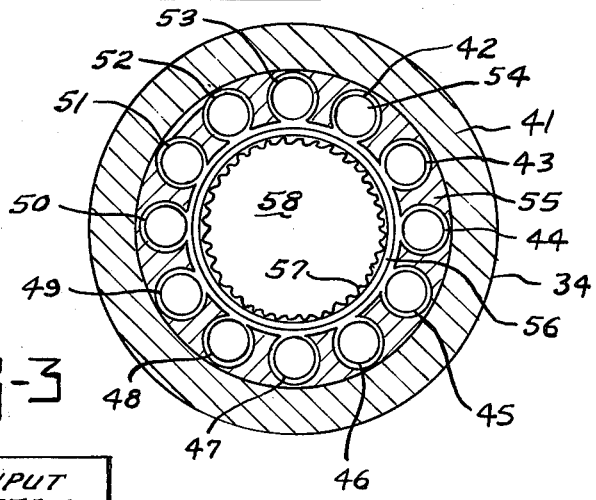
FIG. 4 is a representative cross section view of an embodiment of an integral heater, heat storage system, and heat pipe.
Figure 3:
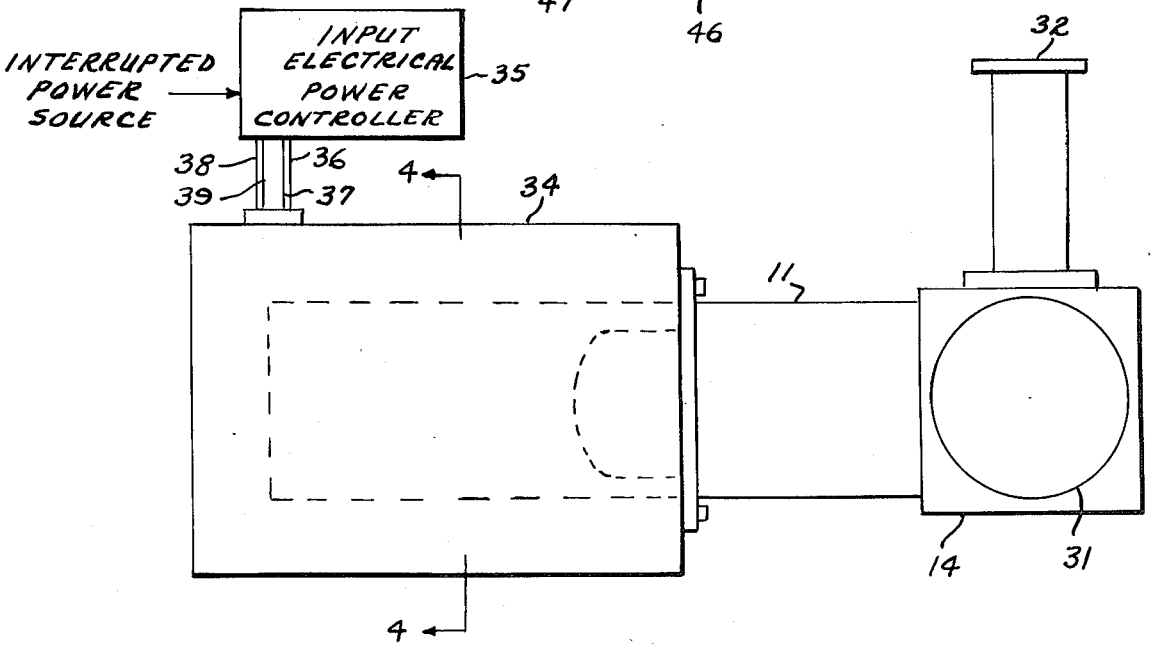
FIG. 3 is a schematic block-pictorial representation of an embodiment of the invention.
Figure 5:
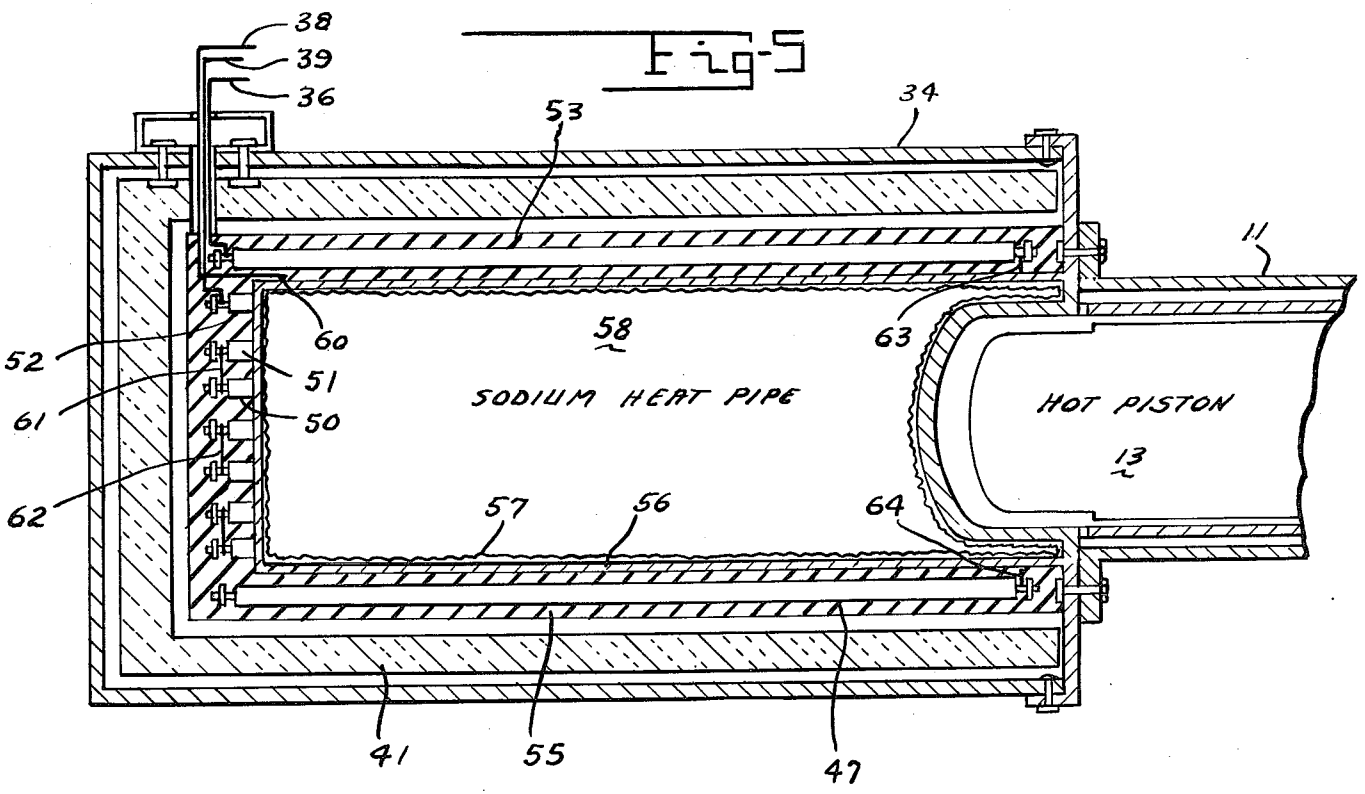
FIG. 5 is a schematic representation of a longitudinal section of an embodiment of the invention coupled to the hot cylinder of a Vuilleumier cooler.
Figure 5:
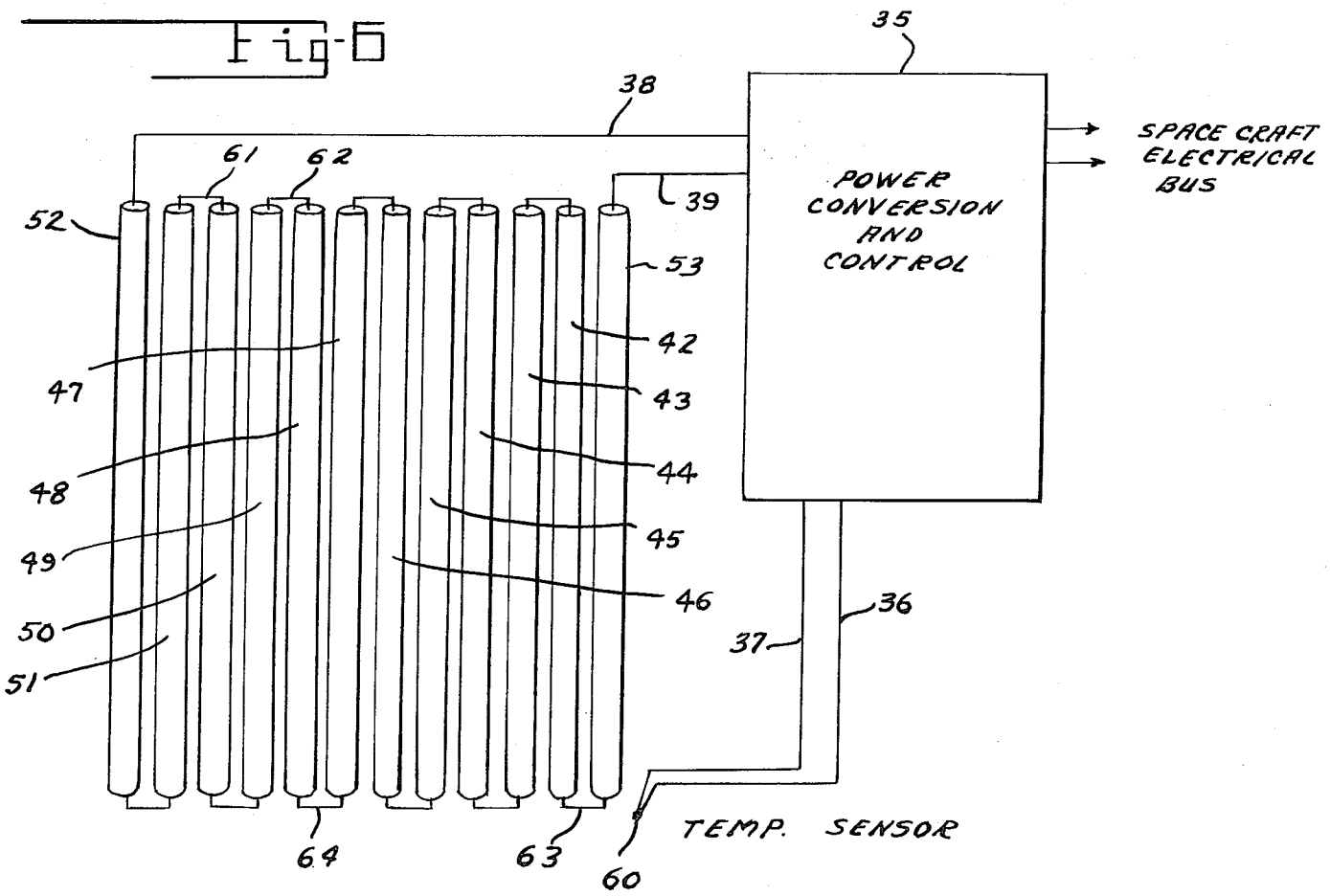

Referring again to FIG. 1, the problem is to provide continuous heat energy to the head of hot cylinder 11. Conventionally it is done by continuously energizing heating element 12. This invention, as representatively illustrated pictorially in FIG. 3 and detailed in FIGS. 4, 5 and 6, provides continuous heat to the head of hot cylinder 11 by the combination of a heat pipe 58 in cooperation with electrical heaters 42 through 53 which are also the containers for the TES material. TES material is well known. Fused salts such as of LiF-MgF and other depending upon the particular temperature range required are common and suitable. These cylinders 42 through 53 serve two functions, they are containment for the TES material and they are also electrical resistance heating elements. The material from which the cylinders are fabricated obviously must be compatible with the TES material that they contain to prevent chemical reaction. The cylinders containing the TES material are positioned around a central heat pipe 58. The cylindrical heating elements containing the TES material are normally, but not necessarily, connected electrically in series as shown in FIG. 6. The electrical current flowing through the TES containers both melts the TES material and supplies thermal energy to the heat pipe. The heat pipe then effects a heat transfer to the head of the hot cylinder. The electrical power input is conventionally controlled by controller 35 in cooperation with temperature sensor 60. The temperature control is not critical. Normal ranges of temperature variations of the head of the hot cylinder for normal operation of the cooler are typically from about 1300° F to 1420° F. The temperature controller may thus be set to turn on electrical power when the temperature drops below approximately 1375° F and to turn off electrical power when the temperature goes above about 1410° F. (Instead of a step control it may be a smooth functional control for maintaining approximately 1400° F.) The heater elements (the TES containers) supply the thermal energy required to melt the TES material and also that required for the operation of the cooler. Obviously, when the primary source of power is interrupted no thermal energy is supplied by the electrical heating elements, and during these times thermal energy flows from the TES material into the heat pipe and then to the head of the hot cylinder lowering the temperature of the TES material. The system is conventionally designed to operate under the condition that primary electrical power will be regained before complete solidification of the TES material and the flow of thermal energy to the head of the hot cylinder decreases to such an extent as to fail to maintain the hot cylinder head at its designed minimum temperature of operation.

A typical embodiment of the invention as illustrated and used with a conventional Vuilleumier cooler has the following structural fabrication and characteristics of operation. The heat pipe 58 with screen wick structure 57 is of conventional design and may have sodium for the working fluid. The heat pipe wall 56 extends to the juncture of the cylinder head with the wall of the hot cylinder. The conventional heat pipe screen wick 57 is the conduit for the sodium from the cylinder head to the heat pipe wall. The TES material containers 42 through 53 are positioned in thermally conductive, electrically insulating material 55, such as alumina, which is surrounded by the conventional multi-foil thermally insulating blanket 41, all contained in cylindrical case 34. (It is to be noted that FIGS. 4 and 5 are separate representative illustrations and are not to be construed as being separate views of the same structure. For instance the case wall 34 is not detailed in FIG. 4, and for clarity enlarged air gaps are shown between the two types of insulation 55 and 41, and between insulation 41 and case 34 in FIG. 5.)

Thermal energy is supplied by an electrical current flowing from the primary source, controlled by the controller 35, through the TES containers 42 through 53. The containers also function as resistive heater elements. Stainless steel and inconel are suitable materials from which to fabricate the TES containers. These containers are constructed to provide for making an electrical connection at each end as shown in FIGS. 5 and 6 so that they can be electrically connected with each other by conductors as represented at 61, 62, 63, and 64, and with out-going leads 38 and 39. The thermal energy storage material 54 contained in the containers should be electrically stable and have a relatively low electrical conductivity so that the major part of the current will travel through the container walls. The particular embodiment illustrated and being described for use with a conventional Vuilleumier cooler for IR sensors has a capacity of approximately 1.1 killowatt hour (3,960,000 joules) which is sufficient to supply the required thermal energy, of the user (the Vuilleumier cooler) and also the losses through the insulation 41. The approximate power required for this particular embodiment is approximately 80 amperes at approximately 15 volts to both fuse the TES material and provide the thermal energy requirement of the user. Generally all containers will be connected in series as shown in FIG. 6, but this is not a requirement. Two parallel electrical paths may be used and the power supplied at approximately 8 volts and 150 amperes. It is to be understood that the resistance of the containers is a function of their wall lengths and thickness which may be varied to provide any normal suitable voltage and current requirement characteristics. The electrical current flowing through the container-heater elements is controlled by the conventional temperature controller 35 in response to the temperature sensed by the conventional temperature sensor 60 located on the heat pipe wall 56. The electrical insulator sheath 55 of alumina or other similar material, is needed to provide support to the TES material containers and to prevent electrical shorting between adjacent containers and between the containers and the wall 56 of the heat pipe. The thermal energy transfer from the TES containers to the heat pipe will be both by radiation and by conduction through the electrical insulation and supporting material 55.

A typical embodiment of the invention for use in an orbiting satellite having a 12-hour cycle with 11 hours of primary power available each cycle (one hour power interruption), has the following performance characteristics, expressed on a per orbit (12-hour) cycle.

Power output 1000 watts/hr for 12 hours (continuous)
Power input 1200 watts/hr for 11 hours
Power to TES 100 watts/hr for 11 hours
Power from TES 1000 watts/hr for 1 hour
Power loss 100 watts/hr (continuous)
Typical temperature variation of TES during charging 1375°–1410° F
Typical temperature variation of TES during discharge 1325°–1365° F The invention has been described and illustrated as applied to supplying continuous thermal power to a Vuilleumier cooler from an interrupted electrical power source. It is to be understood that the invention is not limited to this application, but that it comprises apparatus forming a system that is efficient, compact, and relatively light weight, for supplying continuous thermal energy to a user system from interrupted electrical primary power.

I claim:

1. An integral heater thermal energy storage device for providing continuous thermal energy to a user system from an interrupted electrical power source comprising:

a. a heat pipe for conducting thermal energy to the said user system;
b. thermal energy storage material contained in an electrical said heat pipe; and c. means for providing a flow of electrical current from the said source through the said container whereby thermal energy flows from the said container to both the said thermal energy storage material and to the said user.

2. An integral heater thermal energy storage device for providing a continuous thermal energy flow to a user system from an intermittently interrupted primary electrical power source comprising:

a. a fused salt of low electrical conductivity providing a thermal energy storage material;

b. an electrically conductive container containing the said thermal energy storage material, the said container having an input and an output electrical connection;

c. a heat pipe thermally communicating with the said container and with the said user system providing a thermal energy flow from the said container to the said user system; and d. means for controlling the flow of electrical energy from the said intermittently interrupted primary electrical power source into the said input and output connections of the said container.

3. Apparatus for continuously supply thermal energy to the hot cylinder head of a Vuilleumier cyrogenic cooler from a periodically interrupted electrical energy source comprising:

a. thermal energy storage material of a fused fluoride salt;

b. a plurality of Inconel containers containing the said thermal energy storage material;

c. means for making electrical connections to the said containers;

d. a sodium heat pipe thermally communicating with the said hot cylinder head;

e. an electrically insulating, thermally conducting material surrounding the said heat pipe;

f. means for positioning the said plurality of containers in insulative relationship in the said electrically insulating, thermally conductive material; and g. a temperature sensor positioned on the said heat pipe; and h. means cooperating with the said temperature sensor, the said periodically interrupted electrical energy source, and the said electrical connections to the said containers for controlling the current flow from the said electrical source into the said containers.

* * * * *

UNITED STATES PATENT AND TRADEMARK OFFICE

CERTIFICATE OF CORRECTION

PATENT NO. : 3,984,980

DATED : October 12, 1976

INVENTOR(S) : Joseph Wise

It is certified that error appears in the above-identified patent and that said Letters Patent are hereby corrected as shown below:

Col. 2, line 62, change "other" to -- others --. Col. 4, line 68, after "electrical", insert -- conductive container positioned in thermal communication with the --. Col. 5, line 24, change "supply" to -- supplying --.

Signed and Sealed this

Twelfth Day of April 1977

[SEAL]

*Attest:*

RUTH C. MASON
*Attesting Officer*

C. MARSHALL DANN
*Commissioner of Patents and Trademarks*